United States Patent [19]

Kimura

[11] Patent Number: 5,043,708

[45] Date of Patent: Aug. 27, 1991

[54] APPARATUS FOR DETECTING SINGLE-YARN BREAKAGE IN A TWO-FOR-ONE TWISTER

[75] Inventor: Tatsuo Kimura, Nara, Japan

[73] Assignee: Murata Kikai Kabushiki Kaisha, Kyoto, Japan

[21] Appl. No.: 500,381

[22] Filed: Mar. 28, 1990

[30] Foreign Application Priority Data

Mar. 31, 1989 [JP] Japan ..... 1-81231

[51] Int. Cl.[5] ..... G08B 21/00

[52] U.S. Cl. ..... 340/677; 57/81; 73/160

[58] Field of Search ..... 340/677; 73/160; 57/81; 66/161, 163; 139/353, 370.1

[56] References Cited

U.S. PATENT DOCUMENTS

| | | | |
|---|---|---|---|
| 3,183,381 | 1/1980 | Gotoh | 340/677 |
| 3,345,812 | 10/1967 | Pickering | 57/81 |
| 3,672,146 | 6/1972 | Adams | 57/81 |
| 3,759,026 | 9/1973 | Hope | 57/81 |

*Primary Examiner*—Glen R. Swann, III

*Attorney, Agent, or Firm*—Spensley Horn Jubas & Lubitz

[57] ABSTRACT

As yarn travels toward a take-up device after having passed a ballooning area, the travelling course thereof is bent through contact with a pressure sensor. An alarm device generates an alarm when the contact pressure of the yarn, which is monitored by the pressure sensor, is abnormally lowered.

5 Claims, 2 Drawing Sheets

APPARATUS FOR DETECTING SINGLE-YARN BREAKAGE IN A TWO-FOR-ONE TWISTER

FIELD OF THE INVENTION

The present invention relates to an apparatus for detecting single-yarn breakage in a two-for-one twister for stacked yarn packages or two ply yarns.

RELATED ART STATEMENT

In a two-for-one twister for stacked yarn packages, yarns released from two yarn packages are doubled during twisting and taken up into a single yarn.

At that time, if only one of the two yarns is broken, the yarn breakage cannot be detected by a conventional yarn-breakage sensor. Therefore, an abnormal yarn comprising a single yarn is continuously wound and the cut yarn is either wound on a part of a two-for-one twister or is scattered around. This not only results in a waste of yarn but also requires extensive labor to restore proper operation.

Even in processes which do not employ two-stacked yarns, when a yarn package comprises two ply yarns, one yarn constituting the two ply yarns is sometimes broken during a twisting process, in which case, similar troubles occur.

A mechanical or optical yarn-breakage sensor heretofore ordinarily used results in many errors in detecting a single yarn breakage in a two-for-one twister.

OBJECT AND SUMMARY OF THE INVENTION

In view of the foregoing, an object of the present invention is to provide a means for promptly detecting a single-yarn breakage in a two-for-one twister for processing two-stacked packages or two ply yarns.

The apparatus for detecting single-yarn breakage comprises a pressure sensor whereby when a yarn travels toward a winding device after having passed a ballooning area, a travelling course thereof is bent, and an alarm device for generating an alarm when the contact pressure of a yarn monitored by said pressure sensor is abnormally lowered.

The apparatus according to the present invention has a pressure sensor which detects a contact pressure of yarns. The contact pressure is proportional to the tension of the yarns which have been already twisted and wound. The tension of the yarn drawn from the two-for-one twister is relatively high since yarn is wound against a centrifugal force in the ballooning area. The tension is constant is a fixed twisting condition but when a single yarn breakage occurs, the tension lowers to approximately $\frac{2}{3}$ of a normal value depending on the kind of yarns. Accordingly, in this case, the contact pressure of yarn being detected by the pressure sensor rapidly lowers. The alarm device detects this change to give an alarm.

DETAILED DESCRIPTION OF A PREFERRED EMBODIMENT

An embodiment of the present invention will be described with reference to the drawings.

Figure 1:
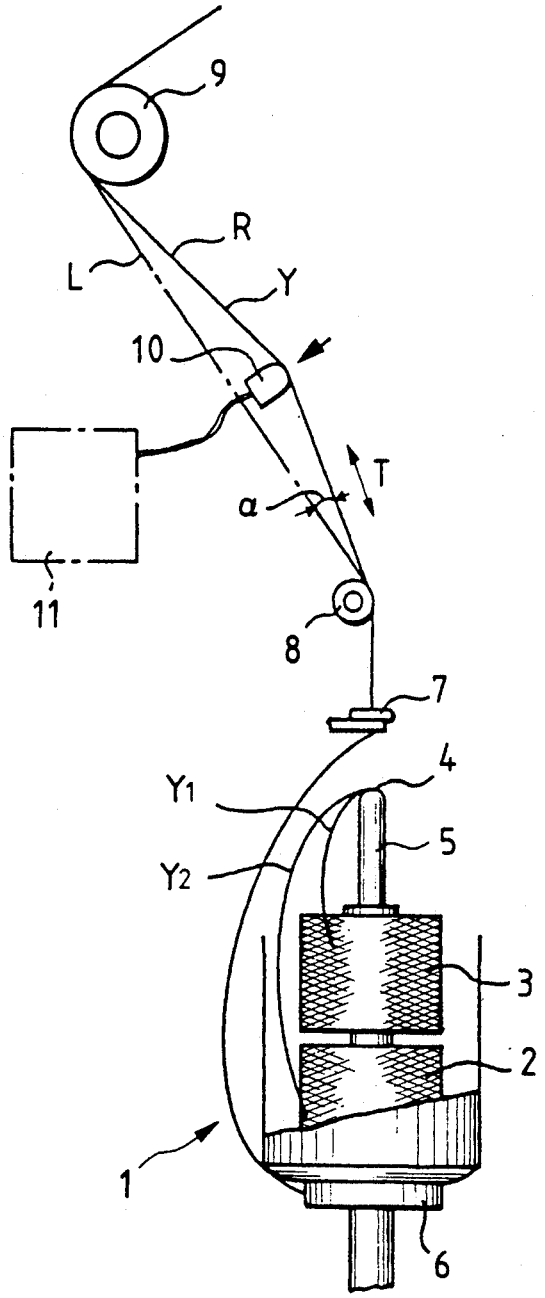
FIG. 1 is a schematic view showing an embodiment of the present invention.

FIG. 1 shows one example of a sensor device for detecting a single-yarn breakage, which is mounted on a two-for-one twister for two stacked packages. The two-for-one twister is for a known two-stacked yarn package. Yarns Y1 and Y2 released from yarn packages 2 and 3 enter a tensioner 5 from a yarn guide hole 4, are drawn out, in a doubled state, of a yarn outlet which opens to the outer periphery of a rotary disc 6, reach a balloon guide 7 while ballooning, and are wound on a take-up device (not shown) via guide rollers 8 and 9.

In the two-for-one twister, the original travelling course of a doubled yarn Y drawn out of the ballooning area to the balloon guide 7 is on a straight line L which connects a yarn disengaging point of the guide roller 8 with a yarn entry point of the guide roller 9. A piezo-electric element 10 which is a pressure sensor of a single-yarn breakage sensor device is arranged in a guide fashion to prevent the doubled yarn Y from travelling on the straight line L at the shortest distance. Accordingly, the doubled yarn Y bends its course in the state where the piezo-electric element 10 is installed, and travels along the path R.

Figure 2:
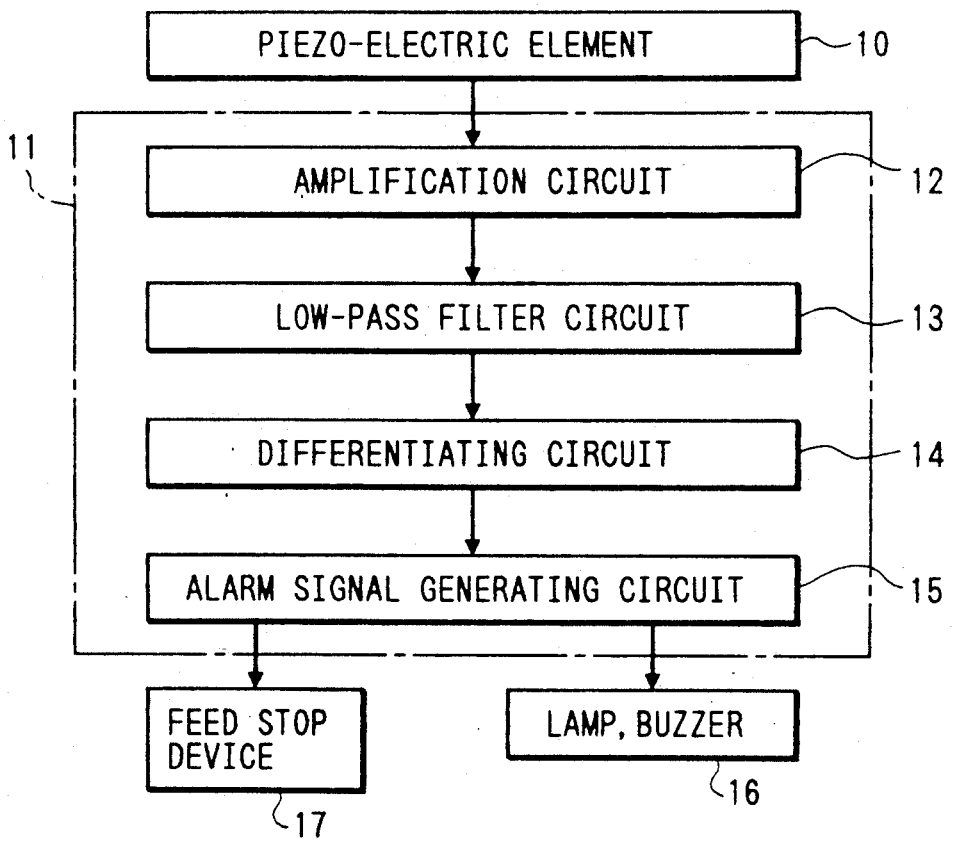
FIG. 2 is a block diagram of an alarm device shown in FIG. 1.

As one example, an alarm device 11 comprises, as shown in FIG. 2, an amplification circuit 12 for amplifying an electric signal from the piezo-electric element 10, a low-pass filter circuit 13 for removing only a superlow frequency component from the amplified signal, a differentiating circuit 14 for an output signal of a filter circuit, an alarm signal generating circuit 15 actuated on the basis of the output, from the differentiating circuit 14.

The alarm device 11 has a buzzer lamp 16 actuated on the basis of an alarm signal and a feed stop device 17 connected thereto. The feed stop device 17 has a hook-like member at the extreme end of a bar whose end enters a flier rotational area between the yarn packages 2 and 3 and the yarn guide hole 4 to thereby stop the feed, the device 17 being actuated by air pressure.

Here, the alarm includes, in addition to an operation which sounds a buzzer for alarming a single-yarn breakage and flickers a lamp, an operation which provides an electric signal for actuating a means for stopping an abnormal operation such as stoppage of feed.

For element 10, one may use any, suitable sensor such as a pressure sensitive element which can be a mechanical pressure sensor such as a piezo-electric element, a strain gauge, a semiconductor pressure sensor, etc., or an element which detects a physical quantity other than pressure.

When the two-for-one twister is operating normally, a contact pressure P proportional to tension T of the doubled yarn Y which travels in contact with the piezo-electric element 10 acts on the latter. The larger the deflection angle of a yarn travelling course resulting from the presence of the piezo-electric element 10, the higher the contact pressure P and output signal voltage. Therefore, a suitable installation position of a piezo-electric element is selected according to the magnitude of yarn tension T, the sensitivity of the piezo-electric element 10, ect. If a damage to a yarn could result from the sliding of the doubled yarn Y against the piezo-electric element 10, the piezo-electric element 10 is brought into contact with the yarn through a roller.

The amplification circuit amplifies a voltage generated by the piezo-electric element 10 on the basis of the contact pressure of the doubled yarn Y to a level sufficient for processing. An electric signal sent from the piezo-electric element 10 includes a variation of voltage corresponding to a variation of frequent and fine yarn tension produced even during the normal operation, and the amplification circuit amplifies it as it is. The lowpass filter circuit receiving an output signal of the amplification circuit is to prevent an erroneous operation of the alarm device due to a variation of the normal signal voltage, and erases a normal voltage variation and outputs a signal voltage proportional to an average yarn tension T. When a single yarn breakage occurs, this output voltage lowers. An output voltage of the differentiating circuit which receives the first mentioned output voltage is 0 if an input signal voltage is constant. When a single yarn break occurs in that state whereby the tension T of the doubled yarn Y rapidly reduces, an input voltage of the differentiating circuit also rapidly lowers. Therefore, the differentiating circuit generates a pulse-like output voltage. The alarm signal generating circuit receives this to give an alarm signal.

Upon receipt of an alarm signal, a buzzer is actuated and a lamp is lit to alarm a single-yarn breakage. At the same time, an electromagnetic valve is opened and pressurized air is supplied to the feed stop device, whereby the hook member together with the bar are moved to an operating position to stop the feed. The stoppage of the feed can be executed by other mechanisms, the details of which are not essential to the present invention.

Since in the above-described example, the installation position of the piezo-electric element 10 is between the guide rollers 8 and 9, tension is less affected by the balloon, and tension is also less affected by the traverse of the yarn on the side of the take-up device. A reduction in tension at the time of a single-yarn breakage can be accurately detected without being affected by these variations.

As described above, the apparatus of the present invention comprises a pressure sensor at which, when a yarn travels toward a take-up device after having passed a ballooning area, a travelling course thereof is bent, and an alarm device for generating an alarm when a contact pressure of a yarn detected by said pressure sensor is abnormally lowered. Attention was paid to the fact that when a single-yarn breakage occurs, tension of yarn is reduced, and it has been demonstrated that the reduction is yarn tension is easily detected by the pressure sensor to render possible prompt detecting of a single-yarn breakage. Therefore, by using the sensor apparatus of the present invention, it is possible to minimize waste of the two-stacked yarn packages or two ply yarns resulting from a single-yarn breakage in the two-for-one twister, and time loss.

What is claimed is:

1. An apparatus for detecting single-yarn breakage in a two-for-one twister for processing two stacked packages or two ply yarns, the apparatus comprising:

a pressure sensor contacting a yarn as the yarn travels toward a take-up device after having passed a ballooning area, whereby the travelling course thereof is bent, and an alarm device for generating an alarm when the contact pressure of a yarn monitored by said sensor is abnormally lowered.

2. An apparatus as claimed in claim 1, wherein said pressure sensor is a piezo-electric element.

3. An apparatus as claimed in claim 2, wherein said alarm device comprises an amplification circuit for amplifying an electric signal from the piezo-electric element, a low-pass filter circuit for removing a low frequency component from the amplified signal, a differentiating circuit for differentiating an output signal of said low-pass filter circuit, and an alarm signal generating circuit actuated on the basis of an output from said differentiating circuit.

4. An apparatus according to claim 3, wherein said differentiating circuit monitors the output signal from said low-pass filter circuit and produces an output signal which is supplied to said alarm signal generating circuit when the output signal from said low-pass filter circuit changes by a predetermined amount.

5. An apparatus according to claim 1, wherein said pressure sensor is disposed so as to bend the travelling course of the yarn.

* * * * *